US006261215B1

(12) United States Patent
Imer

(10) Patent No.: US 6,261,215 B1
(45) **Date of Patent: *Jul. 17, 2001**

(54) RECTANGULAR THIN FILM PACK

(76) Inventor: Rodney Haydn Imer, C/ Navarro i Reverter 3, 08017 Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 09/481,023

(22) Filed: Jan. 11, 2000

Related U.S. Application Data

(62) Division of application No. 09/137,969, filed on Aug. 21, 1998, now Pat. No. 6,036,365, which is a continuation of application No. 08/111,995, filed on Mar. 5, 1997, now Pat. No. 5,842,790.

(30) Foreign Application Priority Data

Mar. 21, 1996 (DE) ..... 296 05 278

(51) Int. Cl.[7] ..... B31B 41/00

(52) U.S. Cl. ..... 493/210; 493/218; 493/193; 493/196

(58) Field of Search ..... 493/210, 218, 493/193, 194, 195, 196, 936, 924; 53/456, 563, 478; 383/107, 122, 80, 104

(56) References Cited

U.S. PATENT DOCUMENTS

| | | | | |
|---|---|---|---|---|
| 2,500,341 | * | 3/1950 | Burnett | 383/104 |
| 2,880,775 | * | 4/1959 | Beattie | 383/104 |
| 3,924,521 | * | 12/1975 | Hanson et al. | 53/456 |
| 4,041,851 | * | 8/1977 | Jentsch | 383/401 |
| 4,363,821 | * | 12/1982 | VanderLugt | 52/456 |
| 5,289,937 | * | 3/1994 | Boots | 383/104 |
| 5,323,922 | * | 6/1994 | Lapoint et al. | 383/104 |
| 5,397,707 | * | 3/1995 | Verfaillie | 383/107 |
| 5,518,313 | * | 5/1996 | McAdam | 383/4 |
| 5,556,205 | * | 9/1996 | Gallie et al. | 383/24 |
| 5,564,833 | * | 10/1996 | Proffitt | 383/22 |
| 5,842,790 | * | 12/1998 | Imer | 383/122 |
| 6,036,365 | * | 3/2000 | Imer | 383/104 |

FOREIGN PATENT DOCUMENTS

| | | | | |
|---|---|---|---|---|
| 28062/36 | * | 4/1938 | (GB) | 383/107 |

* cited by examiner

*Primary Examiner*—Stephen F. Gerrity
*Assistant Examiner*—Sam Tawfik
(74) *Attorney, Agent, or Firm*—Chadbourne & Parke LLP

(57) ABSTRACT

A pack comprises a horizontal base and vertical side walls formed from a blank. The side walls are joined to each other in planes perpendicular to the base and form stiffening ribs. The side walls are seamlessly joined to the base and the base is seamless. The pack is produced by folding the blank and joining the side walls.

9 Claims, 7 Drawing Sheets

RECTANGULAR THIN FILM PACK

This application is a divisional application of application Ser. No. 09/137,969, filed Aug. 21, 1998 and now U.S. Pat. No. 6,036,365 and which is a continuation of application Ser. No. 08/811,995, filed Mar. 5, 1997 and now U.S. Pat. No. 5,842,790.

BACKGROUND OF THE INVENTION

The invention concerns a stable, standing, essentially rectangular form of a pack made from thin film or membrane-like material which uses a minimum of film area in relation to the volume of the contents of the pack and which because of its structural form can also use thinner film or membrane material than existing standing pouches, and to which various known and new types of top designs can be applied to facilitate opening and resealing or reclosing.

Further, the invention is concerned with a pack design that can be filled and sealed at high speeds comparable to the filling and sealing speeds of metal cans and glass jars, this ability being achieved by the special form of the base of the invention taken together with the method of manufacture of the pack which achieves an open box-like form that is stable and capable of being handled and transported at high speeds by means of conveyors.

Many forms of thin film or membrane packs are known, amongst them several forms of standing pouches. Concerning standing pouches, all of them have complex forms in the area of the bottom or base of the pack, such forms being necessary to give the pack some form of standing stability, particularly when filled with liquids. Because of these complex base configurations, all of these packs use more film or membrane than the invention, for a given filled volume. Moreover, some of these existing pack forms have vertical stiffening ribs to lend stability to the pack, but this stability is weakened in some cases by the method of folding the sides under to form the base of the pack, and in other cases by the means with which the walls are joined to the base, with the result that a stiffer film or membrane must be used to achieve the desired stability.

In regard to filling and sealing, all of these existing forms of standing packs use handling, filling and sealing systems which were developed specifically for known film type structures and which utilise single or up to about four filling heads which in turn limit the rate at which they can be filled and sealed to about 120 units per minute. This rate has been acceptable for the markets found for such packs but which is not acceptable for the high volume packaging required for many mass produced food and other products where rates of up to 2000 units per minute are required. Such high rates can only be achieved by multiple head rotary and in-line filling systems such as are used for the filling of bottles, jars and cans, which pack forms are in themselves stiff, stable standing packages exhibiting the necessary form stability for high speed handling. To date, no means has been found to utilise the existing forms of thin film flexible packs in such filling systems.

With recent progress in the development of special films capable of withstanding the high temperatures used in the cooking or autoclaving of food products packed in jars and cans, it is now possible to consider the use of thin film packs for such products, but it is not possible to achieve the required filling rates as explained above.

SUMMARY OF THE INVENTION

The invention provides solutions to overcome the limitations of existing thin film flexible pack forms in that it provides a thin film flexible pack that uses less material than existing forms in a form which can be handled and filled at much higher rates than existing packs. The pack can also be manufactured and filled and sealed on machines that are in many ways similar to known vertical form, fill and seal machines, and on variations of horizontal batch filling and sealing machines. The production rates at which these machines can produce filled and sealed packs is however slower than when multiple head rotary machines are used.

The invention is a pack that is manufactured in an open cubic-rectangular form and before it is filled and sealed consists of four rectangular walls which are integral with the base of the pack without requiring any form of join between the walls and the base.

The side walls are joined to the front and back walls at the vertical corners of the pack by heat sealing or by adhesives or other known joining means, such that the joins form vertical stiffening ribs as is known in the art, such stiffening ribs having a width of up to 10 mm or more but typically about 3 mm to 8 mm. In its preferred form, the base consists of a single layer of film or membrane, integral with all four walls and in a variation, consists of a double layer, with each layer separately integral with two walls, but when joined together, integral with four walls.

In its preferred form, the pack is constructed from a single layer of flat film or membrane in pre-cut or on-the-roll form laid out on a work surface where a vertical mould, with cross-sectional dimensions the same as the required inner cross-sectional dimensions of the pack, is placed over that portion of the film that is to form the base of the pack and against the vertical sides of which the film portions that are to form the vertical walls of the pack are pressed by upwardly folding the portions of the film that are to form the walls of the pack. At the vertical lines where the extremities of each wall are in contact with the adjoining walls, that is at the vertical corners of the pack, the film or membranes of the adjoining walls are joined together to form vertical stiffening ribs.

The pack which is now in its cubic-rectangular form, can now either be filled through the vertical inner form which would be the case when vertical form, fill and seal methods are employed, or when modified batch filling and sealing methods are employed, and then sealed at the top, or preferably removed from the form and transported to a filling station and there filled and later sealed. This is preferable because by this means one can produce filled packs at a higher production rate, utilising multiple formers and multiple stationary or rotating filling stations, than is otherwise possible by filling through the vertical inner form and then sealing. In both cases the sealing at the top can be carried out by means known in the art or by means hereafter described.

Examples of thin film or membrane-like materials that can be used for the manufacture of such a pack include low density polyethylene films, coextruded or laminated high density and low density polyethylene films, or co-extruded or laminated combinations of polyester, polyethylene, aluminum foil, paper, polyamide films, plus various vapour barriers films such as $SiO_3$, amongst others.

The thickness of such films or film combinations can vary from 20 microns up to 200 microns or more.

Techniques for sealing the joins necessary to form the pack and to form any of the various top sealing formats include heat sealing, ultrasonic sealing, and adhesives.

A further means of constructing the pack is possible as a variation to the foregoing and as is later described herein, being a means whereby two strips of the film or membrane material are laid out at 90° to one another with one strip overlapping the other to form the shape of a cross, whereby the width of each strip is equal to the width of the wall plus the widths of the joining areas, and the length of each strip is equal to twice the length of the wall plus the width of the base measured in the long direction of the strip.

The two strips are joined together at the extremities of the overlap by adhesives, ultra-sound or heat sealing, with the provision that where heat sealing is employed, the overlying strip has heat sealable material on both sides of the strip.

The resulting form of the joined together strips is a cross similar to the previously described pre-cut form and can be formed into the described cubic-rectangular form as described.

This variation has the benefit of significantly reducing the raw film materials usage, in that there are no off-cuts or waste.

The invention is preferably a pack made from thin film or membrane like material with a base made of a single layer of said film/membrane that is conjunctional/integral with all four walls of the pack, adjacent pairs of which are themselves joined together in the vertical plane such that the joins form vertical stiffening ribs as are known in the art, and which together with the special form of the base and with the way in which the pack is initially formed give the pack its stability and enable it to be used to contain liquids, powders, granulates and coarse materials or smaller objects, and which enable it to be manufactured and formed and filled and sealed at a much higher production rate than any similar standing pouch by virtue of its stable and open form after initial manufacture that allows it to be filled by means similar to the known high production means used to fill cans, jars and bottles.

The invention has the further advantage that it can be and filled and sealed by several existing systems known in the art, such as by filling through the vertical inner form and then sealing in the forming apparatus, or preferably such as by removing it from the form and then filling it at a later stage and time in a separate filling station after which it is sealed.

The pack has no seams or joins in the base and therefore a reduced number of locations where leaks may occur due to faulty sealing.

The base of the pack is flat with no projections and can therefore be transported by conveyors or similar means in the production process without catching on parts of the apparatus.

The pack, as presented to the public in its filled and sealed form, contains much less material than other packs of the type and therefore significantly reduces the amount of waste material that has to be disposed of This is because the pack uses less material than other packs of its type and also because the pack can use a lighter or thinner material than other packs of the type because of its very efficient structural form.

Savings of 10% or more in the area of material are possible with further savings in thickness of up to 20%, meaning total savings in materials of up to 30% or more.

DETAILED DESCRIPTION OF THE INVENTION

Figure 1:
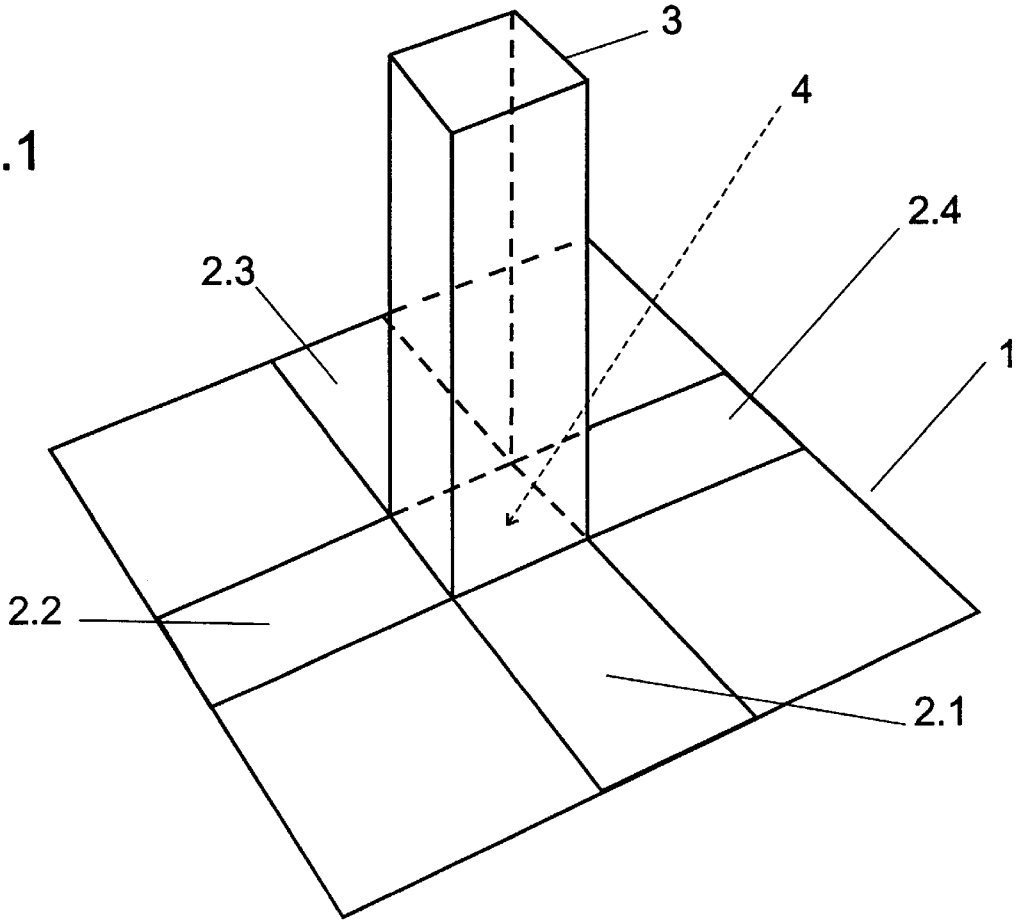
FIG. 1 is a perspective view of one step in forming a pack according to the invention.

FIG. 1 shows the film/membrane 1 and the portions that are to form the vertical walls 2.1, 2.2, 2.3, 2.4 of the pack according to the invention. The inner form 3 is brought into position over the portion of the film/membrane that is to form the base 4 of the pack.

Figure 2:
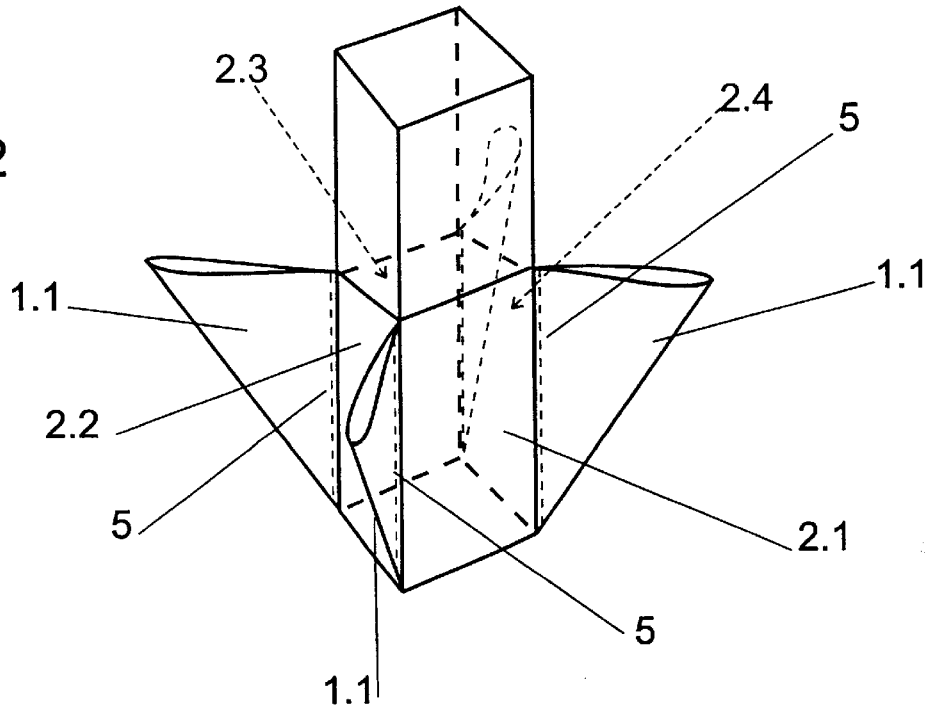
FIG. 2 is a perspective view of another step according to the invention.

FIG. 2 shows the second stage in the formation of the pack, after the walls 2.1 to 2.4 have been folded upwards against the vertical inner form. The portions of film/membrane at the vertical edges of the pack are joined together along the fines 5 shown dotted, by known means to form the vertical stiffening ribs 7 shown in FIGS. 5 and 6 at the four vertical corners of the pack.

In FIG. 1 the film/membrane is shown as a complete rectangle or as part of a cut roll of material. After folding and forming and sealing, the excess portions of the film/membrane 1.1 shown in FIG. 2 are cut off As an alternative, the film/membrane shown in FIG. 1 could consist of a pre-cut cross-form as shown in FIG. 3.

Figure 3:
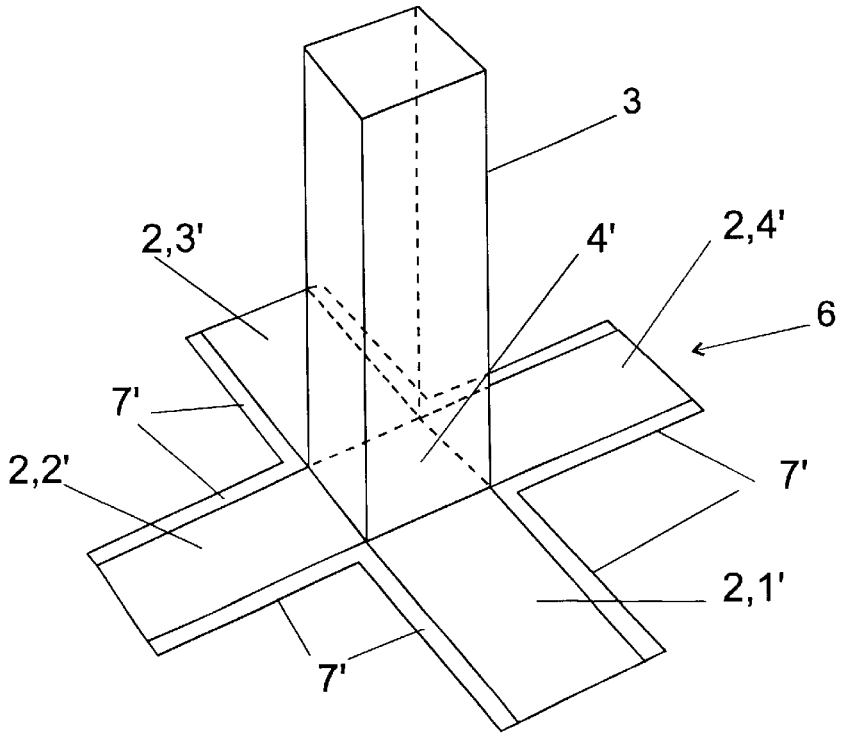
FIG. 3 is an alternative of the embodiment of FIG. 1.

In FIG. 3 the film/membrane has already been pre-cut in the form of a cross 6, with each arm of the cross being as wide as the finished walls 2.1' to 2.4' plus the width of the vertical ribs 7'. The arms of the cross, i.e., the walls are then folded upwards against the inner form and the edges of the walls are joined together along the lines 5 in FIG. 2 shown dotted as described above.

Figure 4:
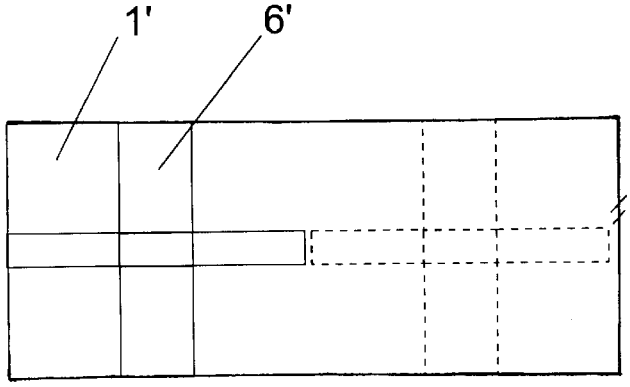
FIGS. 4 and 4A are top views of alternative steps in forming a pack according to the invention.
Figure 4A:
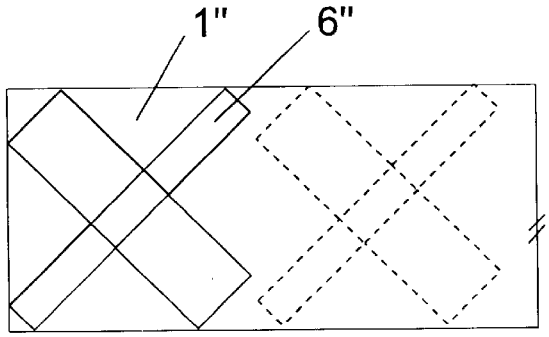

As shown in FIGS. 4 and 4A, in both cases the form of the pack on the original film/membrane may be at 90° to the outer edges of the roll of film 1', 1", or at another angle as may be preferable in order to reduce the area of film/membrane that has to be removed.

Figure 5:
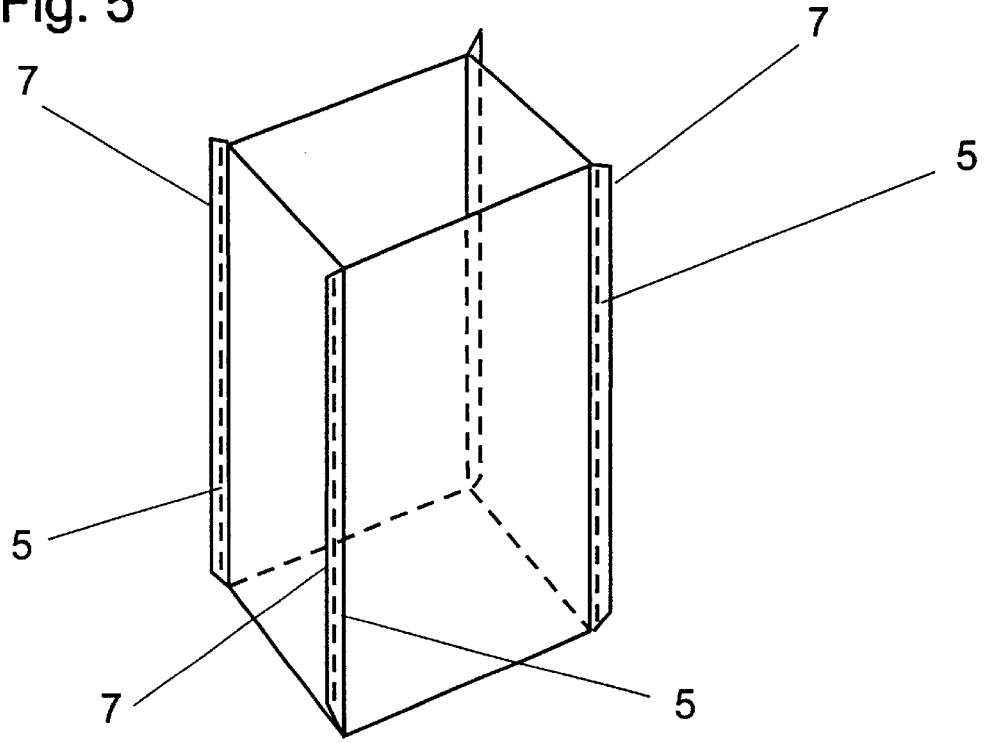
FIG. 5 is shows a further step in forming a pack according to the invention.

FIG. 5 shows the finished pack before filling and closing.

Figure 6:
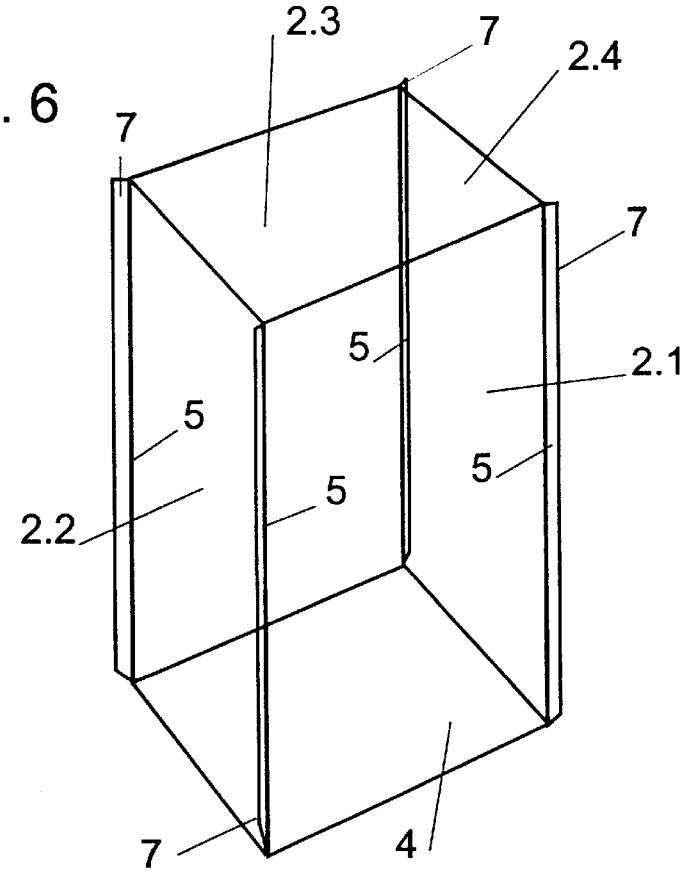
FIG. 6 is shows another embodiment of FIG. 5.

FIG. 6 shows the pack in FIG. 5 made of clear see-through film/membrane and clearly shows side walls 2.1–2.4 and that the bottom 4 of the pack is a single layer of film/membrane.

Figure 7:
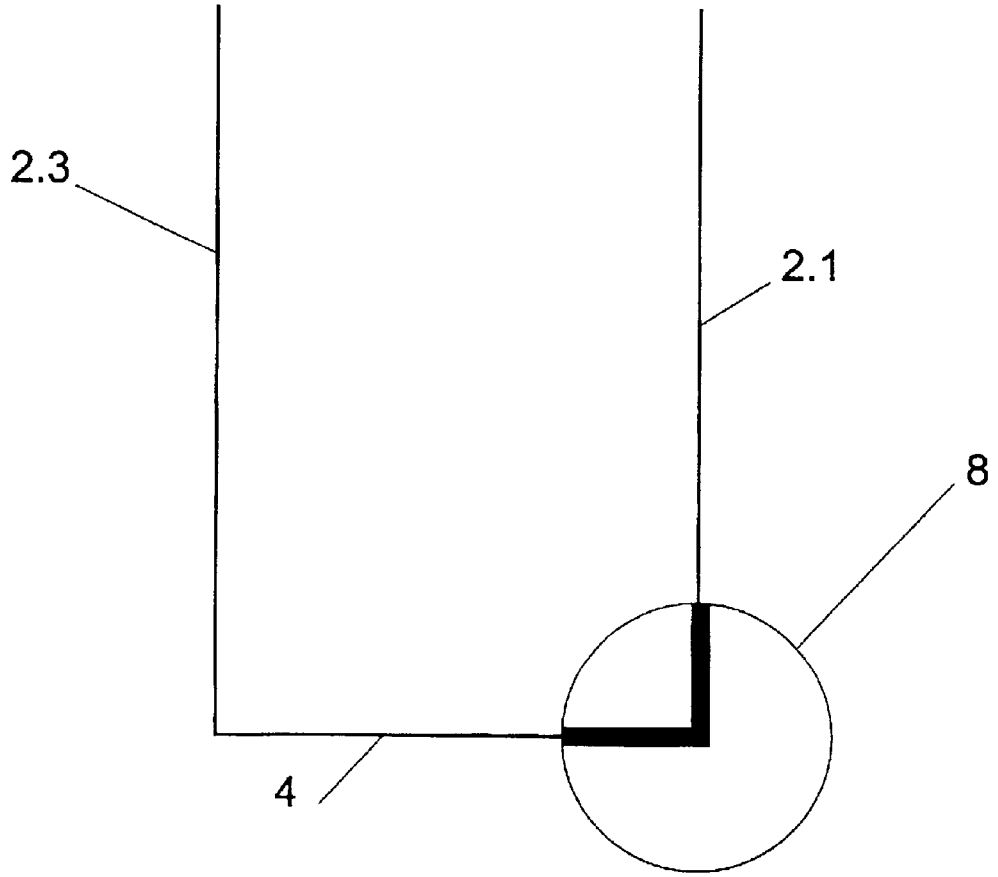
FIG. 7 is a sectional view of FIG. 6.

FIG. 7 shows a vertical cross-section through the pack in FIG. 6, either on the x-axis or the y-axis, as both cross-sections are the same. The conjunction of the wall and the base is shown in magnified detail 8 where it can be seen that the wall and the base are contiguous without a join.

Figure 8:
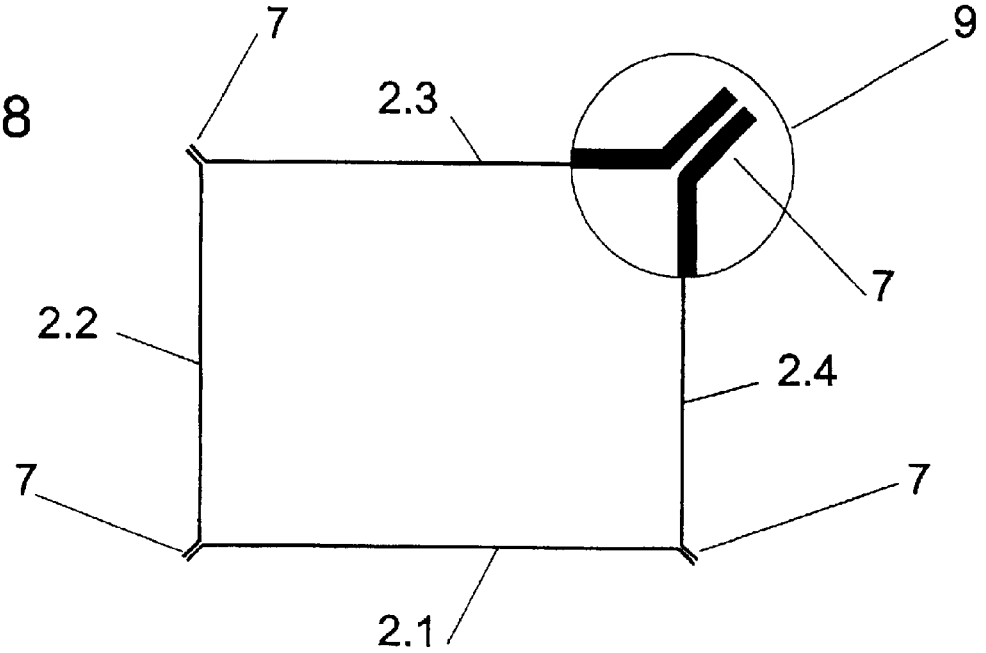
FIG. 8 is a sectional view of FIG. 6.

FIG. 8 shows a horizontal cross-section through the pack in FIGS. 6 and 7. The pack may have any desirable cross-sectional format. The junction of two of the walls is shown in magnified detail 9. The two outstanding parts of the walls that form the vertical ribs 7 are here shown slightly separated for clarity, but are joined together in forming the pack. All of the vertical corners, i.e., stiffening ribs are the same.

Figure 9:
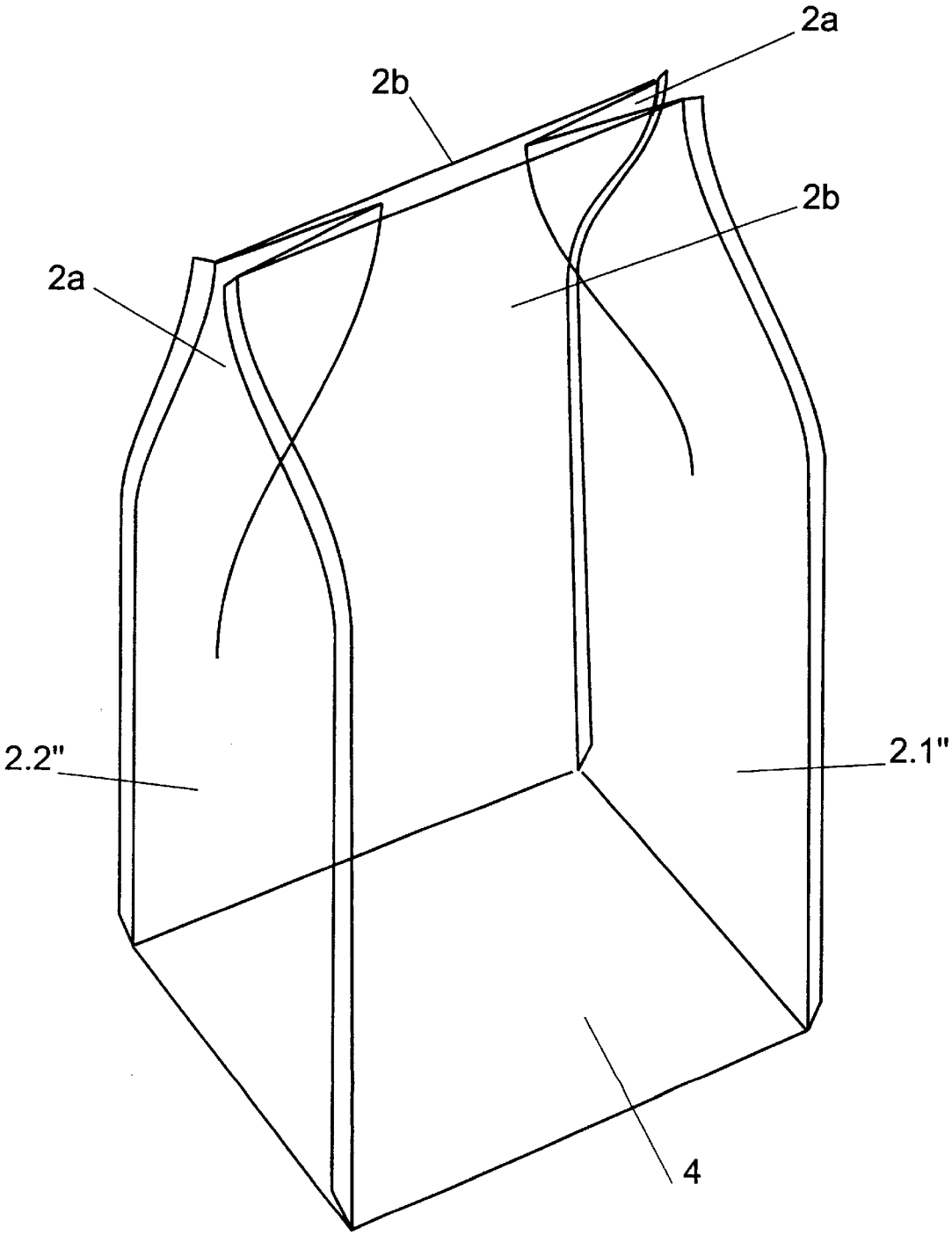
FIG. 9 is a further step in sealing the pack of FIG. 5.

FIG. 9 shows the pack in FIG. 6 with the top portion of the pack in position for sealing by means known in the art.

The top portions 2*a* of sides 2.1" and 2.2" are in-folded and the top portions 2*b* of the other sides are brought together. Other top closing methods applicable to vertical form, fill and seal methods and to modified batch filling and sealing methods are also possible and are as described in the following paragraphs.

Figure 10:
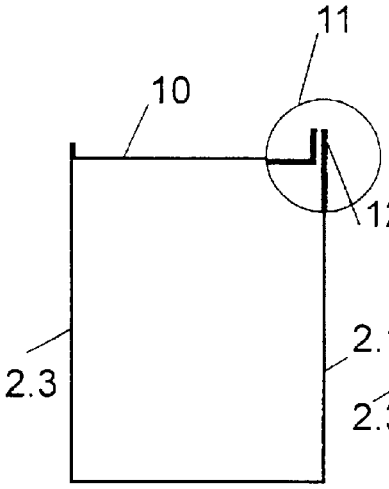
FIGS. 10, 10A and 10B are alternative methods of sealing the pack according to the invention.
Figure 10A:
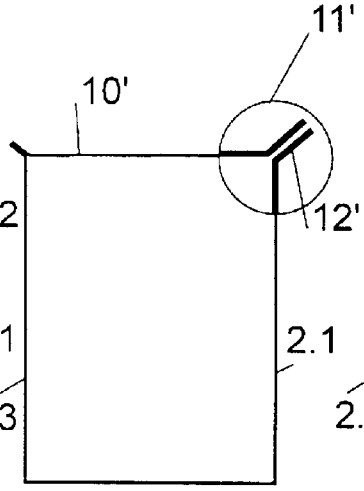
Figure 10B:
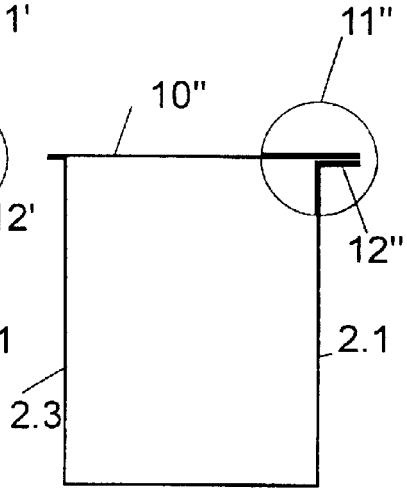
Figure 11:
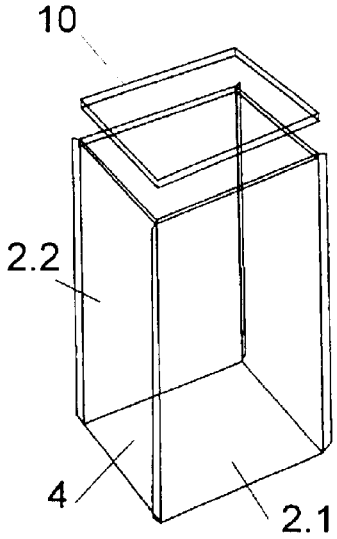
FIGS. 11, 11A and 11B are alternative embodiments of the packs for the seals of FIGS. 10, 10A and 10B.
Figure 11A:
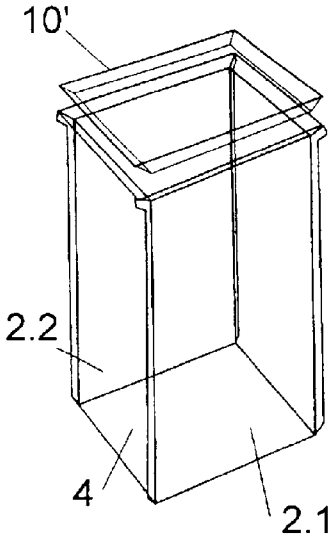
Figure 11B:
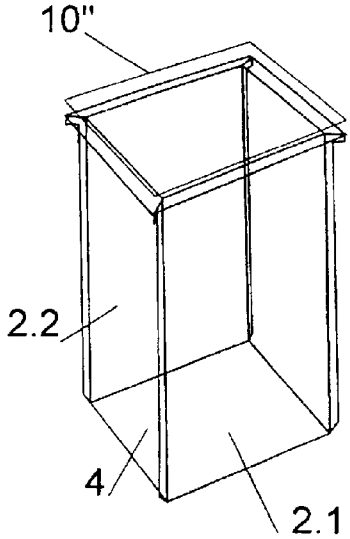

FIGS. 10, 10A and 10B show vertical cross-sections of the invention illustrating several new forms of sealing the top of the pack, these forms being shown in perspective views in FIGS. 11, 11A and 11B. Other known forms of sealing the top of the pack may be utilised.

FIGS. 10, 11, 10A and 11A show variations of closing the top of the pack that could be employed in a vertical form, fill and seal manufacturing system, whereby a pre-formed cap 10, 10' and 10" made of plastic, filled plastics, or other film or membrane-like material is inserted into the top of the pack after filling, and whereby the vertical or sloping edges of the cap are joined to the inner vertical or sloping top edges of the pack by heat sealing, ultrasonic sealing or adhesives. The variations are shown as seals 12, 12' and 12" in details 11, 11' and 11".

In FIGS. 11 and 11A the sloping top edges of the top of the walls of the pack are formed by appropriate shapes built on to the inner vertical mould and on to the upwardly folding forms which fold the walls into the vertical position and which join the vertical sealed edges, such that during the upward folding, the top edges of the walls are so formed.

In the vertical form, fill and seal manufacturing method, the upwardly folding forms remain in position during the filling procedure and after filling, during which the inner vertical mould is withdrawn from the pack, the cap is inserted by mechanical means and pressed down into position between and against the vertical or sloping inner surfaces of the top edges of the walls, and joined to the said top edges of the walls by sealing means as described, the sealing taking place between the top edges of the upwardly folding forms and the mechanical positioner of the cap.

FIGS. 10B and 11B show a further variation of the closing of the top of the pack which could be employed in the vertical form, fill and seal manufacturing method and which could also be employed in a horizontal batch filling method whereby a number of packs are filled at the same time by multiple filling heads.

Under these methods the top of the pack is closed by joining a flat strip of flexible film or membrane like material as described to the inner top surfaces of the top edges of the walls of the pack, which in this case are formed in a horizontal plane by methods as described above in the paragraphs referring to FIGS. 10, 11, and 10A and 11A.

The horizontal portions of the top edges of the walls are held in position by vacuum points arranged in the top edges of the upwardly folding forms during the filling procedure during which the inner vertical mould is withdrawn, and the strip which is to be used to close the pack is drawn into position by mechanical means and pressed down on to the horizontal portions of the top edges of the walls by sealing forms built on to the vertical inner mould and joined to the said top edges by the sealing means previously described, the sealing taking place between the upper edges of the upward folding forms and the under side of the sealing forms built on to the inner vertical mould, which after being withdrawn from the pack during the filling procedure is again lowered slightly to affect this sealing.

Figure 12:
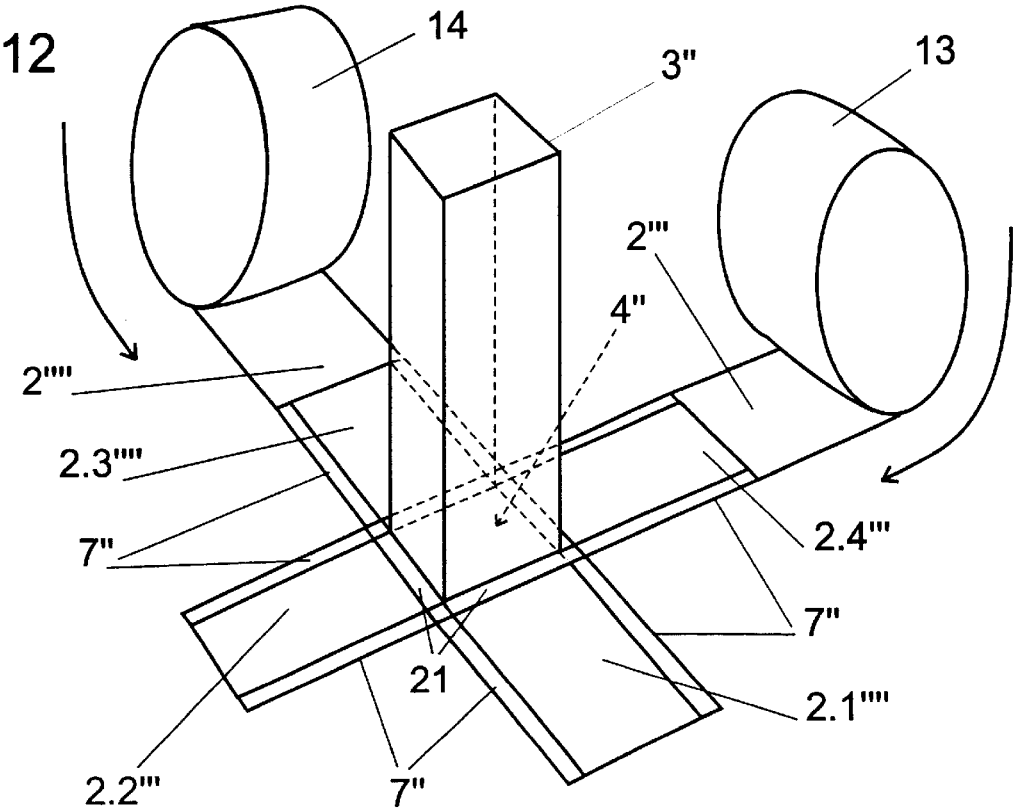
FIG. 12 is a perspective view of a further alternative of the embodiment of FIG. 1.
Figure 12B:
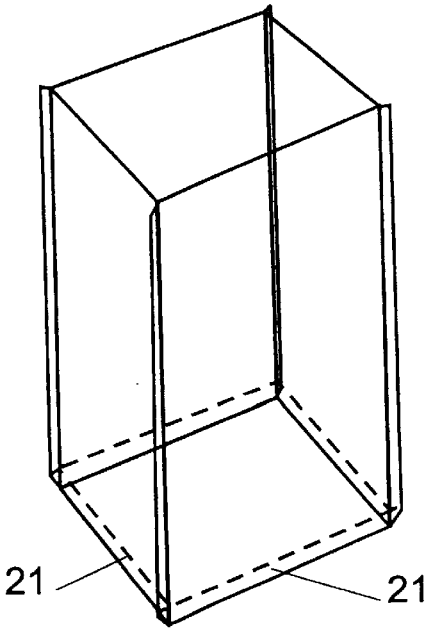
FIG. 12B is a perspective view of the pack in FIG. 12 and shows the pack after forming, analogous to FIG. 6.
Figure 12A:
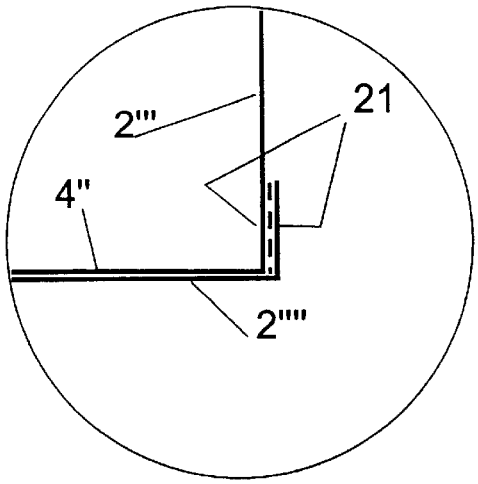
FIG. 12A is a partial cross-section of the pack in FIG. 12 analogous to detail 8 in FIG. 7.

FIGS. 12, 12A and 12B show a variation in the construction of the pack as described above in which significantly less raw material is used compared to the previously described forms, and in which the pack construction begins with two strips of the film/membrane material.

FIG. 12 can be compared to FIG. 3. In FIG. 3, the film/membrane has been pre-cut in the form of a cross whereby in FIG. 12 the cross form is achieved by unrolling a strip 2"" from the supply roll 14 on to the work surface and then unrolling a second strip 2"' from the second supply roll 13 over this at an angle of 90° to 2"". With the provision that strip 2"' has heat sealable material on both sides and that strip 2"" has heat sealable material at least on the side facing 2"', the two strips can be heat sealed together preferably in the contiguous region 21, during the forming process.

The inner form 3" is placed in position over the middle portions of the strips 2"' and 2"" and, as previously described, the portions of the strips 2"' and 2"" that are to form the walls of the pack 2.1"", 2.3"", 2.2"' and 2.4"' are upwardly folded and joined at their adjacent edges 7' by means as described, concurrently with the contacting portions of both strips 2"' and 2"" at 21, which are at the lower extremities of the walls.

The base of the pack 4' is thereby formed and consists of two layers being respectively the middle portions of strips 2"' and 2"" where they overlap. By this means, there results a base which is still flat and clear of obstructions, the joins being on the lower parts of the walls above the base. A benefit of this method is that the base now has a stronger construction more resistant to penetration.

FIG. 12A shows a cross-sectional detail of the pack in FIG. 12 as in detail 8 in FIG. 7 and shows that the two strips 2"' and 2"" are joined above the base 4' at 21.

The pack as shown in FIG. 12B clearly has the same form as previously described forms.

What is claimed is:

1. A method for producing a pack, comprising the steps of:

providing two rectangular strips of material, each strip having a thickness of from 20 to about 200 microns, joining the strips at intermediate portions thereof to form a cross, wherein the arms of the cross form four vertical side walls extending from a flat horizontal base demarcating an interior space, and joining the side walls together at vertical corners of the pack and in planes perpendicular to the base to seal the interior space at the side walls and to form vertical stiffening ribs extending along the length of the pack and outwardly of the interior space.

2. The method according to claim 1, wherein the side walls have a top portion and further comprising closing the top portion with a preformed cap.

3. The method according to claim 2, wherein the cap has a horizontal body and vertical edges and further comprising joining the edges to the top portions of the side walls.

4. The method according to claim 2, wherein the cap has a horizontal body and sloping edges and wherein the top portions of the side walls have sloping edges and further comprising joining the sloping edges of the side walls with the sloping edges of the cap.

5. The method according to claim 2, wherein the cap has a horizontal body and horizontal edges and wherein the top portions of the side walls have horizontal edges and further comprising joining with the horizontal edges of the cap with the horizontal edges of the side walls.

6. The method according to claim 1, wherein the strips comprise one of a thin film or a membrane material.

7. The method according to claim 1, wherein the strips are cut from two rolls of material.

8. The method according to claim 1, further comprising infolding two opposing side walls and joining top portions of all of the walls to close the pack.

9. The method according to claim 1, further comprising folding the arms of the cross after joining the intermediate portions of the strips.

* * * * *